US005536335A

United States Patent [19]

Burris

[11] Patent Number: 5,536,335

[45] Date of Patent: Jul. 16, 1996

[54] LOW SILICON RAPID-CARBURIZING STEEL PROCESS

[75] Inventor: Kenneth W. Burris, Peoria, Ill.

[73] Assignee: Caterpillar Inc., Peoria, Ill.

[21] Appl. No.: 282,937

[22] Filed: Jul. 29, 1994

[51] Int. Cl.[6] ..... C23C 8/22

[52] U.S. Cl. ..... 148/233; 148/319

[58] Field of Search ..... 148/233, 319

[56] References Cited

U.S. PATENT DOCUMENTS

| | | | |
|---|---|---|---|
| 4,836,864 | 6/1989 | Murakami et al. | 148/233 |
| 4,921,025 | 5/1990 | Tipton et al. | 148/16.5 |

FOREIGN PATENT DOCUMENTS

| | | | |
|---|---|---|---|
| 47-32182 | 8/1972 | Japan | 148/233 |
| 57-23741 | 3/1978 | Japan . | |
| 61-253346 | 4/1985 | Japan . | |

OTHER PUBLICATIONS

Article entitled "Internal Oxidation During Carburizing and Heat Treating" from Metallurgical Transactions A, vol. 9A, dated Nov. 1978.

*Primary Examiner*—Sikyin Ip
*Attorney, Agent, or Firm*—Pankaj M. Khosla

[57] ABSTRACT

A process for forming a low silicon rapid-carburizing wear resistant steel article includes selecting an article formed of a steel material having less than about 0.05% silicon by weight, and carburizing the article for a preselected time and temperature to form an austenitic surface and attain a carburized case depth which is at least 5% greater than the carburized case depth of a similar article formed from a steel material having a range of about 0.09% to about 0.25% silicon by weight and being carburized at substantially same conditions of time and temperature. After quenching, the as-carburized surface transforms into a microstructure of martensite and retained austenite, being substantially free of intergranular oxides. A low silicon rapid-carburizing wear resistant steel article formed according to the present invention is particularly useful for making gears, couplings, shafts, bearings, and similar articles subjected to a combination of high bending loads, surface wear and contact fatigue.

12 Claims, 4 Drawing Sheets

LOW SILICON RAPID-CARBURIZING STEEL PROCESS

TECHNICAL FIELD

The present invention relates to metal heat treatment, and more particularly, to a thermochemical process for case hardening a low silicon steel by carburizing with a gas containing carbon, and a resulting article.

BACKGROUND ART

Carburizing is a thermochemical process for increasing the surface hardness of low-carbon, low-alloy or unalloyed steels, by increasing the carbon content in the exposed surface of steel. Carburizing is typically accomplished by exposing a steel article to a carbonaceous atmosphere containing carbon in an amount greater than the carbon content of the steel, and heating the steel article to a temperature above its austenite transformation temperature. After a desired amount of carbon has been diffused into the steel surface, and a desired carburized case depth has been attained, hardness is induced by quenching.

Gas carburizing is a widely used method for carburizing steel. Being a diffusion process, carburizing is affected by the amount of alloying elements in the steel composition and the carburizing process parameters such as the carbon potential of the carburizing gas, the carburizing temperature and the carburizing time.

During carburizing, the primary purpose is to provide a hardened layer or a case, having a higher carbon content than the core, and a definite depth. Besides the formation of a carbon-rich case on the steel surface, surface oxides are inadvertently formed by the reaction of small amounts of oxygen in the carburizing gas with the alloying elements in steel, such as silicon, manganese and chromium. These surface oxides form in an intergranular manner, i.e., they tend to form along the grain boundaries, extending inwardly from the surface. It is known that the formation of surface oxides have a detrimental effect on the mechanical properties of the carburized steel article, such as bending fatigue strength.

In the past, researchers have investigated the effects of lowered levels of silicon on the reduction of intergranular oxides. It is generally known that restricting the amount of silicon in the steel composition is beneficial for reducing the formation of intergranular oxides. An article authored by Ruth Chatterjee-Fischer, titled "Internal Oxidation During Carburizing and Heat Treating", Metallurgical Transactions A, published by American Society for Metals and the Metallurgical Society of AIME, Vol. 9A, Nov. 1987, pp. 1553–60, concluded that the silicon content in steel significantly affects surface oxidation. However, this article fails to recognize any relationship between reduced silicon content and the enhancement of carburized case depth.

A low silicon carburizing steel was developed by Kobe Steel, Ltd., and described in a Japanese Patent Publication No. 61-253346. To assure favorable surface hardenability and prevent the formation of granular oxides, Kobe limited the amounts of chromium, manganese, silicon and molybdenum to minimize the formation of surface carbides and oxides. However, although the Kobe reference limits the amount of silicon to less than 0.10% by weight to prevent oxide formation, it does not disclose the effect of reduced silicon content on the enhancement of carburized case depth.

Another low silicon carburizing steel was developed by Sanyo Special Steel Co., Ltd., and described in a Japanese Patent Publication No. 57-23741. To accelerate carbon diffusion and assure a faster carburizing time, Sanyo limited the amount of silicon in the steel composition to within a range of 0.06% to 0.12% by weight, in combination with relatively higher amounts of chromium and carbon. However, Sanyo concluded that only decreasing the silicon content by itself does not enhance the carburized case depth in a given time. Further, Sanyo also concluded that the effect of reducing the silicon content on accelerating the carbon diffusion becomes saturated, or minimum, at about a 0.06% silicon content. Contrary to this conclusion and quite unexpectedly, it has been discovered in the present invention, that an enhancement of the carburized case depth is achieved at even lower silicon levels, of below 0.05%, without a decrease in the mechanical properties.

U.S. Pat. No. 4,921,025 issued May 1, 1990 to Tipton et al., and assigned to the same company as this instant invention, discloses a process which uses a low silicon steel having no more than 0.10% silicon, for forming a carburized steel article which is free of surface intergranular oxides and has a high percentage of surface carbides. Although the Tipton patent is very useful for forming steel articles having enhanced resistance to bending loads, surface wear and contact fatigue, Tipton does not suggest exploiting the advantages of further reducing the amount of silicon to result in a significantly reduced carburization time.

It is desirable to have a carburized steel article that demonstrates a combination of an improved response to carburization, and a surface microstructure that is substantially free of intergranular oxides. In addition, it also desirable that after carburizing, the steel article does not require any removal of material from the carburized surface. It is further desirable that the steel article be able to resist a combination of bending loads, surface wear and contact fatigue. Further, it is extremely desirable to provide a carburizing process which will yield a substantial increase in the carburized case depth for a fixed carburization time. The present invention is directed to overcome one or more of the problems as set forth above.

DISCLOSURE OF THE INVENTION

In one aspect of the invention, a process for forming a low silicon rapid-carburizing wear resistant steel article, comprises, selecting an article formed of a steel material having less than about 0.05% silicon by weight and carburizing the article at a preselected temperature and for a preselected period of time and attaining a carburized case depth, being at least 5% greater than the carburized case depth of a similar article formed from a steel material having a range of about 0.09% to about 0.25% silicon by weight and being carburized at substantially the same preselected temperature for substantially the same preselected period of time. After forming an as-carburized surface comprising austenite and being substantially free of intergranular oxides, the article is quenched and the as-carburized surface is transformed into a microstructure of martensite and retained austenite.

In another aspect of the invention, a process for forming a low silicon rapid-carburizing wear resistant steel article, comprises, selecting an article formed of a steel material having a composition, comprising, by weight percent, a range of about 0.07% to about 0.33% carbon, a range of about 0% to about 0.05% silicon, less than 8% hardenability elements, less than 1% grain refining elements, and the balance iron and trace impurities and carburizing the article at a preselected temperature and for a preselected period of time and attaining a carburized case depth, being at least 5% greater than the carburized case depth of a similar article formed from a steel material having a range of about 0.09% to about 0.25% silicon by weight and being carburized at substantially the same preselected temperature for substantially the same preselected period of time. After forming an as-carburized surface comprising austenite and being substantially free of intergranular oxides, the article is quenched and the as-carburized surface is transformed into a microstructure of martensite and retained austenite.

In yet another aspect of the invention, there is provided a low silicon rapid-carburizing steel article having less than about 0.05% silicon by weight, and having a carburized surface that, without any material removed therefrom and without requiring any further finishing, is substantially free of intergranular oxides, and being carburizable, at a preselected temperature and for a preselected period of time, to a case depth being at least 5% greater than the case depth of a similar article formed from a steel having greater than about 0.09% silicon by weight.

BEST MODE FOR CARRYING OUT THE INVENTION

Figure 1:
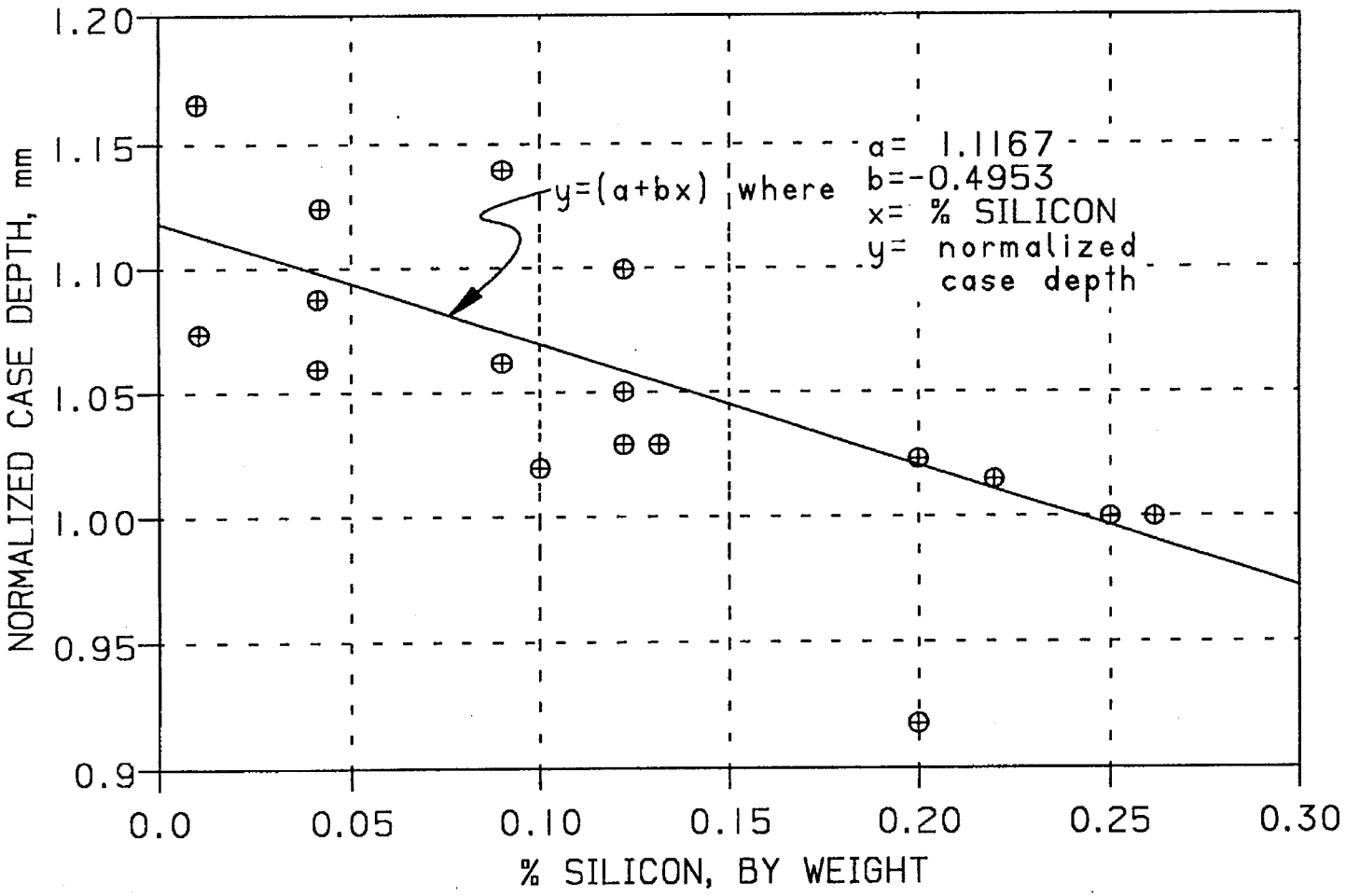
FIG. 1 is a graph showing the relationship between silicon content in the steel composition, and the normalized case depth of articles carburized according to the present invention.

In one aspect of the present invention, a process for forming a low silicon rapid-carburizing wear resistant steel article includes the steps of selecting an article formed of a low silicon steel material, carburizing the article to attain a deeper case depth to 0.40% carbon, than that attained by an article formed of a conventional silicon steel material, controllably cooling the article to the hardening temperature, and quenching the article.

The term "low silicon steel", as used herein, means a steel material containing silicon in the range of 0% to 0.05% by weight, and whose composition in all other respects is recognized as generally suitable for carburizing. It has been discovered, that restricting the amount of silicon in steel to below 0.05%, or preferably, to below 0.01% by weight, not only represses the formation of silicon oxides and chromium and manganese oxides on the surface of the carburized article but actually increases the carburized case depth attained during carburizing, for a given carburizing temperature and time, as compared to conventional silicon steels.

The term "conventional silicon steel", as used herein, means a steel material containing silicon in the range of about 0.1% to about 0.30% by weight, and whose composition in all other respects is recognized as generally suitable for carburizing. Commercially produced low alloy "conventional silicon" carburizing grade steels typically have a composition, by weight percent, within the following ranges:

| | |
|---|---|
| carbon | 0.08 to 0.35 |
| silicon | 0.15 to 0.35 |
| manganese | 0.30 to 1.70 |
| carbide forming elements (such as chromium, vanadium or molybdenum) | 0.20 to 2.50 |
| hardenability agents (such as nickel or chromium) | 0.00 to 6.00 |
| grain refining elements | 0.00 to 1.00 |
| iron and residual elements | balance |

In the above steel composition, if silicon is deleted or restricted to 0.05% or less, it is suitable for the formation of rapid-carburized articles according to the present invention. Accordingly, selection of an appropriate steel composition is an important step.

The term "rapid-carburizing steel", as used herein, means a steel that, when carburized for a fixed period of time and at a fixed temperature, and also at a fixed carbon potential, attains a carburized case depth measured at a diffused carbon content of 0.40% carbon in austenite, of at least 5% greater than, and preferably, 10% greater than the case depth of a conventional carburizable steel. Specifically, low alloy carburizing grade steels, such as one of the SAE 4110 to 4130 series, all modified particularly to limit the silicon to no more than 0.05%, are particularly suited for the formation of rapid-carburized articles such as gears, bearings and shafts. As a result, it is possible to attain case depths that are in a range of 6% to 12% greater than the unmodified SAE 4110 to 4130 steels, which all have silicon in the range of about 0.20 to 0.35%. Conversely, carburizing cycle times can be reduced by about 6% to 12%, while attaining the same case depth, resulting in increased throughput and cost savings.

Although not essential, commercial low alloy carburizing grade steels having relatively small amounts carbide forming elements such as chromium, molybdenum or vanadium, may be modified to be a low silicon rapid-carburizing steel composition. If added, such carbide forming elements should be less than about 1.0%, and preferably less than about 0.5%. Additional hardenability agents may be included but should be limited to amounts less than about 6%. Grain refining elements may be added in amounts less than about 0.25% to promote fine grain size. Deleterious elements such as phosphorous and sulfur, often present in trace amounts, should preferably be limited to no more than 0.05% and 0.08% respectively.

Articles having any of the above described compositions are shaped to a predetermined form by machining from rolled steel, by casting or forging, by consolidating steel powder, or by a combination of forming operations.

After shaping, the article is placed into a carburizing furnace and carburized, preferably in two stages. In the first carburizing stage, called the "boost stage", the carbon potential of the atmosphere in the furnace is greater than the saturation limit of carbon in austenite at the furnace temperature. The saturation level of carbon in austenite is generally designated as "$A_{cm}$", and it is temperature dependent. Hence the carbon potential during the boost stage is maintained above "$A_{cm}$". The temperature of the furnace during the boost stage is desirably maintained within the range of about 1675° F. (913° C.) to about 1825° F. (996° C.) and preferably, at about 1700° F. (927° C.). If the temperature is less than 1675° F., the diffusion process will take too long. If the temperature is greater than 1825° F., there is a risk of grain coarsening. The carbon potential of the atmosphere during the boost stage is desirably maintained in the range of about 1.05% to 1.35%, and preferably, about 1.20%.

The term "case depth", as used herein, is the distance below the surface of the steel, where the carbon content in austenite is 0.40%. The length of time that the article is held in the carburizing oven during the boost stage may vary from about 1.5 hours to 20 hours, depending upon the temperature and carbon potential of the furnace, as well as the amount of silicon content of the steel. At the conditions of temperature and carbon potential described above, and as shown graphically in FIG. 2, the article is desirably held in the furnace during the boost stage, for a period ranging from about 2 hours to 25 hours, and preferably, about 5 hours. Under these conditions, initial case depths ranging from 0.68 mm to about 2.80 mm can be achieved.

In the second carburizing stage, called the "diffuse stage", the carbon potential of the gas atmosphere in the furnace is about equal to the saturation limit of carbon in austenite. Hence the carbon potential during the diffuse stage is maintained about equal to "$A_{cm}$". Typically, the temperature of the furnace during the diffuse stage is desirably maintained within the range of about 1675° F. (913° C.) to about 1825° F. (996° C.) and preferably, at about 1700° F. (927° C.). The carbon potential of the furnace atmosphere during the diffuse stage is desirably maintained in the range of about 0.75% to about 1.05%, and preferably, about 0.85%. The article is desirably held in the furnace during the diffuse stage, for a period ranging from about 0.12 hours to 3.5 hours, and preferably, about 0.6 hours.

An atmosphere having a carbon potential of about 1.5% to 2% can be provided by a gas having a composition of 0.055% $CO_2$, 1% $CH_4$, 20% CO, 40% $H_2$, and the balance $N_2$.

The article, preferably while still in the furnace, is then cooled to the hardening temperature of the steel core, typically about 1520° F. (845° C.).

After cooling the surface of the article to the hardening temperature, it is desirable to maintain the article at the hardening temperature for a length of time sufficient to permit the temperature in the core of the article to cool to the hardening temperature. This process is known as equalizing and is identified in the graphical representation of the process in FIG. 2. The step of equalizing includes maintaining the article desirably, at a temperature of about 1550° F. (845° C.), and for a period in the range of about 5 minutes to about 60 minutes.

A carbonaceous gas atmosphere is maintained about the article during the preceding cooling and equalizing operations to prevent carbon depletion at the surface of the article. Both cooling and equalizing may be carried out in the diffuse stage furnace, so that the same gas used in carburizing may simply be cooled and circulated about the article.

After equalizing, the article is preferably directly quenched from the hardening temperature at a rate sufficiently rapid to transform the surface microstructure to martensite and retained austenite. For quenching, an oil medium is used.

Figure 2:
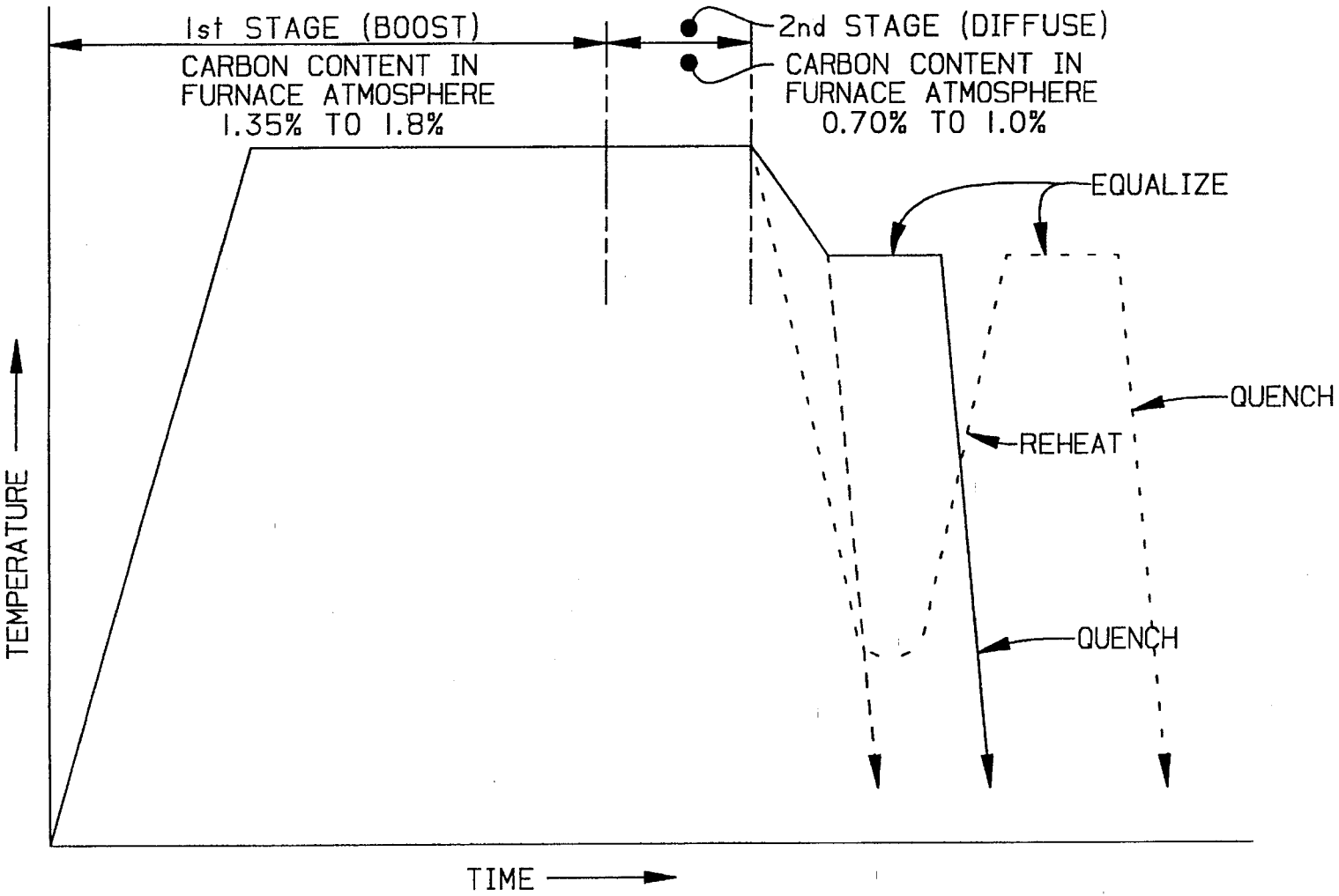
FIG. 2 is a graph illustrating the time and temperature relationship of the carburizing process embodying the present invention.

If it is not convenient to directly quench the article immediately after equalizing, alternative steps represented by the dashed lines in FIG. 2 have been developed. In one alternative, the article may be cooled and then reheated to the hardening temperature of the steel, equalized and quenched. In another alternative, if the mass and geometry of the article are sufficiently small, equalizing may not be required. Hence, the article may be quenched directly after the cooling step.

Shafts and gears are exemplary of articles subjected to high bending loads, surface wear and contact fatigue. Samples of these articles have been successfully formed in accordance with the above described process. Specifically, gears were formed and carburized in accordance with the above process, using steel materials having silicon in amounts varying from about 0.01% to no more than about 0.05% by weight. The total time required to complete the carburizing process and to attain a desired carburized case depth of about 1.0 mm was about 5.5 hours. To contrast the advantages of the present invention with prior art methods, gears formed from steel materials having silicon in the range of 0.09% to 0.22% were also formed and carburized under the same conditions. For the same carburizing time, gears made by the prior art methods attained about 10% to 12% less case depth. Thus, the described process not only forms carburized articles having improved metallurgical characteristics without requiring any finishing of the as-carburized surface, but it is also faster than prior art methods for attaining the desired carburized case depth.

The term "as-carburized surface", as used herein, means that the surface of the carburized steel has not been altered by any finishing operations. The term "finishing operations", as used herein, means any surface operations that may be used to remove material from the surface of the article, such as grinding, sanding, milling or turning.

In the below described illustrative Examples A–E, the desired case depth of a carburized steel sample was varied from 0.60 mm to 2.60 mm. Specifically, the desired case depths in Examples A, B, C, D and E were 0.60 mm, 1.00 mm, 1.40 mm, 1.80 mm and 2.60 mm respectively. For each of the Examples A–E, four steel samples were made, by varying the silicon content from 0.04% to 0.26%. Specifically, the silicon content in samples 1, 2, 3 and 4 was 0.04%, 0.12%, 0.20% and 0.26% by weight, respectively, with the rest of the elements being essentially the same. Steel samples 1–4 had the following composition, by weight percent:

| | Sample 1 | Sample 2 |
|---|---|---|
| carbon | 0.21 | 0.21 |
| silicon | 0.04 | 0.12 |
| manganese | 1.02 | 1.04 |
| nickel | 0.09 | 0.09 |
| chromium | 0.59 | 0.61 |
| molybdenum | 0.15 | 0.15 |
| aluminum | 0.015 | 0.019 |
| phosphorous | 0.019 | 0.021 |
| sulfur | 0.009 | 0.010 |
| iron | balance | balance |
| | **Sample 3** | **Sample 4** |
| carbon | 0.22 | 0.22 |
| silicon | 0.20 | 0.26 |
| manganese | 1.11 | 1.16 |
| nickel | 0.09 | 0.08 |

-continued

| | | |
|---|---|---|
| chromium | 0.62 | 0.58 |
| molybdenum | 0.14 | 0.15 |
| aluminum | 0.02 | 0.036 |
| phosphorous | 0.019 | 0.021 |
| sulfur | 0.010 | 0.011 |
| iron | balance | balance |

Steel sample 1, an embodiment of the present invention, is a low silicon rapid-carburizing steel containing 0.04% silicon. Steel samples 2–4 are representative of typical carburizing grade, higher silicon content, low alloy steels containing 0.12%, 0.20% and 0.26% silicon respectively.

Steel samples 1–4, were made in the following manner: each sample was vacuum-induction melted and poured into a 100 lb. ingot mold. The ingots were reheated to 2250° F. and rolled to round barstocks having a diameter of 30 mm (1.18 inches).

Steel samples 1–4 were carburized in the following manner: each sample was carburized in the furnace separately. A total of 4, 40 mm (1.5 in.) long sections, cut from the barstock of each sample, were placed in a carburizing furnace having a conventional endothermic gas carburizing atmosphere comprising about 0.07% $CO_2$, 0.60% $CH_4$, 20% CO, 40% $H_2$, and the balance $N_2$. The furnace was heated to a temperature of about 1700° F. (927° C.). During the first stage, i.e., the boost stage, the carbon potential of the furnace atmosphere was maintained higher than $A_{cm}$, and as close as the furnace control system permitted, to within the range of 1.15% to 1.35%, with a set point of 1.25%. The sample was held in the carbon rich atmosphere in the furnace, at the same temperature and atmosphere for a time in the range of 2 hours to 23 hours, depending upon the desired case depth specific for each of the individual Examples. During the second stage, i.e., the diffuse stage, the carbon potential of the furnace atmosphere was maintained equal to $A_{cm}$, and within the range of 0.75% to 1.05%, with a set point of 0.85%. The sample was held in the furnace, at a temperature of about 1700° F. (927° C.), for a time in the range of 0.12 hours to 3.23 hours, depending upon the desired case depth specific for each of the individual Examples, and then cooled to the hardening temperature of the steel of 1550° F. (845° C.). The steel sample was held at the above temperature for about 30 minutes to allow the temperature of the interior portions of the sample to equalize to the hardening temperature. After equalizing, the sample was directly quenched in an oil medium.

For all the steel samples in the below described illustrative Examples, the carburized case depth was measured in the following manner: metallographic samples were mounted in conductive bakelite and carbon depth profiles were measured using an ARL Scanning Electron Microprobe Quantometer. The carbon content in steel samples were measured at depths of 0.05 mm, 0.10 mm, and 0.20 mm, and further, in increments of 0.20 mm until the carbon content of the steel core was attained. The samples were tested by using Wavelength dispersive techniques, as are well known to those skilled in the art. Standardization of the testing equipment was done by using three NBS steel standards, containing 0.26%, 0.68% and 1.02% carbon by weight percent in steel. Case depths were expressed as being the depth from the surface of the steel to the point below the surface where the carbon content is 0.40%.

Also, representative sections of the specimens were examined by SEM (Scanning Electron Microscope) techniques.

EXAMPLE A

The desired case depth was set at 0.60 mm. To achieve this desired, or "aim" depth, the samples were kept in the carburizing furnace for 2 hours during the boost stage, and for 0.12 hours during the diffuse stage of carburizing. These residence times are typical for carburizing grade steels, as used in the industry. The following results were obtained from the SEMQ analysis:

| Sample No. | % Si | Carburized case depth | Normalized case depth | Surface Carbon |
|---|---|---|---|---|
| 1. | 0.04 | 0.83 mm | 1.12 | 1.08% |
| 2. | 0.12 | 0.78 mm | 1.05 | 1.07% |
| 3. | 0.20 | 0.68 mm | 0.92 | 1.00% |
| 4. | 0.26 | 0.74 mm | 1.00 | 1.00% |

The results of the SEMQ carbon depth analysis reveal a definite effect of amount of silicon in steel on the carburized case depth attained during carburizing, the trend being that the case depth is inversely proportional to the amount of silicon. The normalized case depths were obtained by dividing the carburized case depths for 0.04%, 0.12%, 0.20% and 0.26% silicon by the case depth for 0.26% silicon. Thus it is observed that sample 1, which is the preferred embodiment of the present invention, has a 12% greater case depth, as compared to sample 4, which is a typical carburizing grade conventional silicon steel, as used in the industry.

EXAMPLE B

The desired case depth was set at 1.00 mm. To achieve this desired, or "aim" depth, the samples were kept in the carburizing furnace for 4.8 hours during the boost stage, and for 0.5 hours during the diffuse stage of carburizing. The following results were obtained from the SEMQ analysis:

| Sample No. | % Si | Carburized case depth | Normalized case depth | Surface Carbon |
|---|---|---|---|---|
| 1. | 0.04 | 1.18 mm | 1.06 | 1.02% |
| 2. | 0.12 | 1.14 mm | 1.03 | 1.00% |
| 3. | 0.20 | 1.13 mm | 1.02 | 0.99% |
| 4. | 0.26 | 1.11 Mm | 1.00 | 0.98% |

As in Example A, the results of the SEMQ carbon depth analysis reveal a similar effect of amount of silicon in steel on the carburized case depth attained during carburizing, the trend being that the case depth is inversely proportional to the amount of silicon. Thus it is observed that sample 1, the preferred embodiment of the present invention, has a 6% greater case depth, as compared to sample 4.

EXAMPLE C

The desired case depth was set at 1.40 mm. To achieve this desired, or "aim" depth, the samples were kept in the carburizing furnace for 8.7 hours during the boost stage, and for 1.1 hours during the diffuse stage of carburizing. The following results were obtained from the SEMQ analysis:

| Sample No. | % Si | Carburized case depth | Normalized case depth | Surface Carbon |
|---|---|---|---|---|
| 1. | 0.04 | 1.48 mm | 1.09 | 1.00% |
| 2. | 0.12 | 1.40 mm | 1.03 | 0.94% |
| 3. | 0.20 | 1.40 mm | 1.03 | 0.95% |
| 4. | 0.26 | 1.36 mm | 1.00 | 0.95% |

As in Examples A and B, it is observed that the case depth is inversely proportional to the amount of silicon. Thus it is observed that sample 1, the preferred embodiment of the present invention, has a 9% greater case depth, as compared to sample 4.

EXAMPLE D

The desired case depth was set at 1.80 mm. To achieve this desired, or "aim" depth, the samples were kept in the carburizing furnace for 13.6 hours during the boost stage, and for 3.5 hours during the diffuse stage of carburizing. The following results were obtained from the SEMQ analysis:

| Sample No. | % Si | Carburized case depth | Normalized case depth | Surface Carbon |
|---|---|---|---|---|
| 1. | 0.04 | 1.98 Mm | 1.12 | 0.99% |
| 2. | 0.12 | 1.80 Mm | 1.02 | 0.95% |
| 3. | 0.20 | 1.78 mm | 1.01 | 1.11% |
| 4. | 0.26 | 1.77 mm | 1.00 | 0.91% |

As in Examples A, B and C, the case depth is inversely proportional to the amount of silicon. Thus sample 1, the preferred embodiment of the present invention, has a 12% greater case depth, as compared to sample 4.

EXAMPLE E

The desired case depth was set at 2.60 mm. To achieve this desired, or "aim" depth, the samples were kept in the carburizing furnace for 25 hours during the boost stage, and for 3.5 hours during the diffuse stage of carburizing. The following results were obtained from the SEMQ analysis:

| Sample No. | % Si | Carburized case depth | Normalized case depth | Surface Carbon |
|---|---|---|---|---|
| 1. | 0.04 | 2.80 mm | 1.12 | 1.06% |
| 2. | 0.12 | 2.77 mm | 1.10 | 1.03% |
| 3. | 0.20 | 2.64 mm | 1.05 | 1.06% |
| 4. | 0.26 | 2.51 mm | 1.00 | 1.01% |

As in Examples A, B, C and D, the case depth is inversely proportional to the amount of silicon. Thus sample 1, the preferred embodiment of the present invention, has a 12% greater case depth, as compared to sample 4.

The results of the above measurements are shown graphically in FIG. 1. The scale for normalized case depth is shown along the right vertical side and the scale for % silicon is shown along the base of the graph. As shown by the solid line representing a reasonable fit for the plotted data points, the carburized case depth increases with decreasing silicon content in steel.

EXAMPLE F

Samples 5–8, representing gears formed from steels having essentially similar base compositions except for silicon amounts, were prepared and heat treated by the carburizing process used for samples 1–4 and described in Examples A–E. The silicon amounts were varied from 0.01% to 0.25%. The manganese and chromium amounts were essentially kept constant. The desired, or the "aim" depth was set at 1.00 mm. After carburizing, the gears samples were cut, polished and analyzed for case depth by SEMQ techniques. Samples 5–10 had the following composition, by weight percent:

| | Samples 5–10 |
|---|---|
| carbon | 0.21 |
| silicon | as shown below |
| manganese | as shown below |
| nickel | 0.09 |
| chromium | as shown below |
| molybdenum | 0.15 |
| aluminum | 0.015 |
| phosphorous | 0.019 |
| sulfur | 0.009 |
| iron | balance |

| Sample No. | % Si | % Mn | % Cr | Carburized case depth | Normalized case depth |
|---|---|---|---|---|---|
| 5 | 0.01 | 0.91 | 0.79 | 1.07 mm | 1.16 |
| 6 | 0.25 | 0.94 | 0.79 | 0.92 mm | 1.00 |
| 7 | 0.09 | 0.97 | 0.75 | 0.97 mm | 1.05 |
| 8 | 0.22 | 0.98 | 0.74 | 0.92 mm | 1.00 |

It is observed that sample 5, representing a preferred embodiment of the present invention, attains a 16% greater case depth than sample 6, which represents a typical industry standard carburized gear steel. Sample 5 also attains about 10% greater case depth than sample 7, which is representative of another low silicon carbide forming gear steel. Although sample 7 shows a 5% deeper case depth than sample 8, which is another typical industry standard carburized gear steel, it has been discovered in this invention that when the amount of silicon in steel is very preferably reduced to such low levels as 0.01%, as done in sample 5, a very significant enhancement in the case depth is attained upon carburization.

Figure 3:
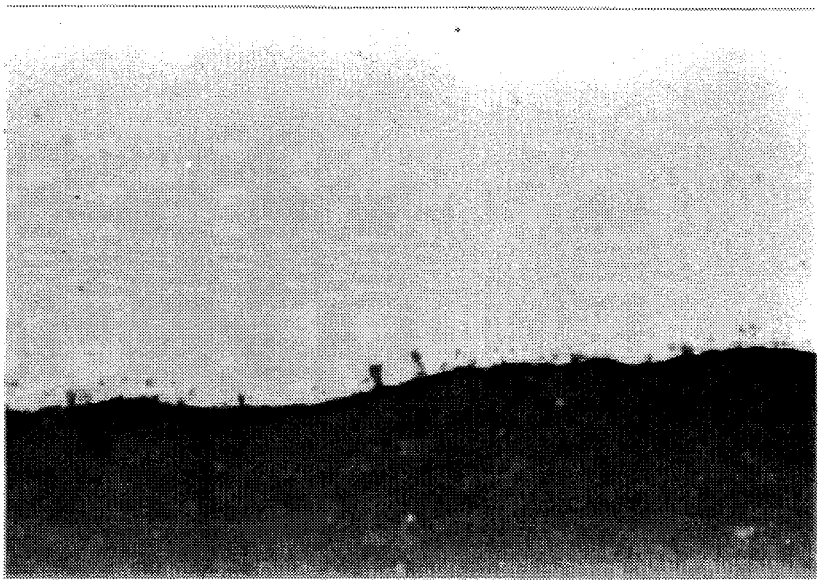
FIG. 3 is a photomicrograph, at 1000X, showing an etched section of a carburized steel gear formed of a low silicon rapid-carburizing steel containing 0.01% silicon according to the present invention.
Figure 4:
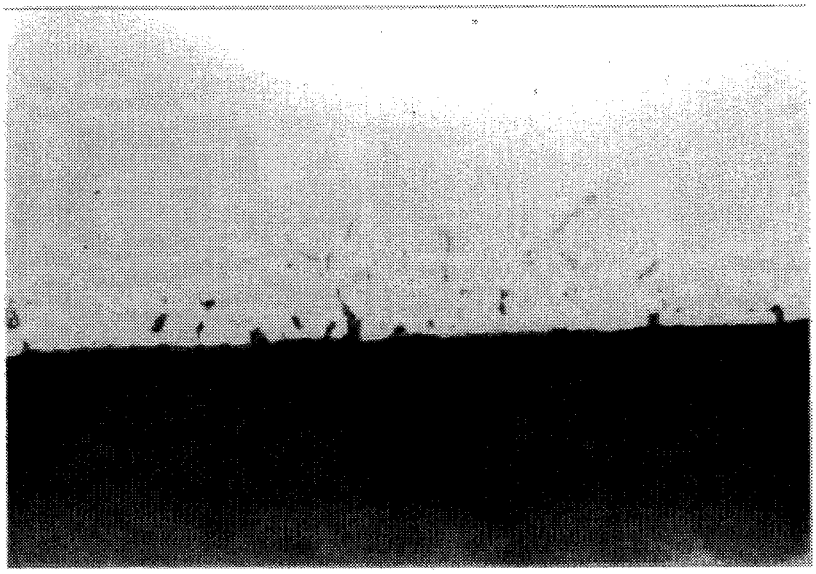
FIG. 4 is a photomicrograph, at 1000X, showing an etched section of a carburized steel gear, carburized with the gear in FIG. 3 but formed of a low silicon carburizing steel containing 0.09% silicon.
Figure 5:
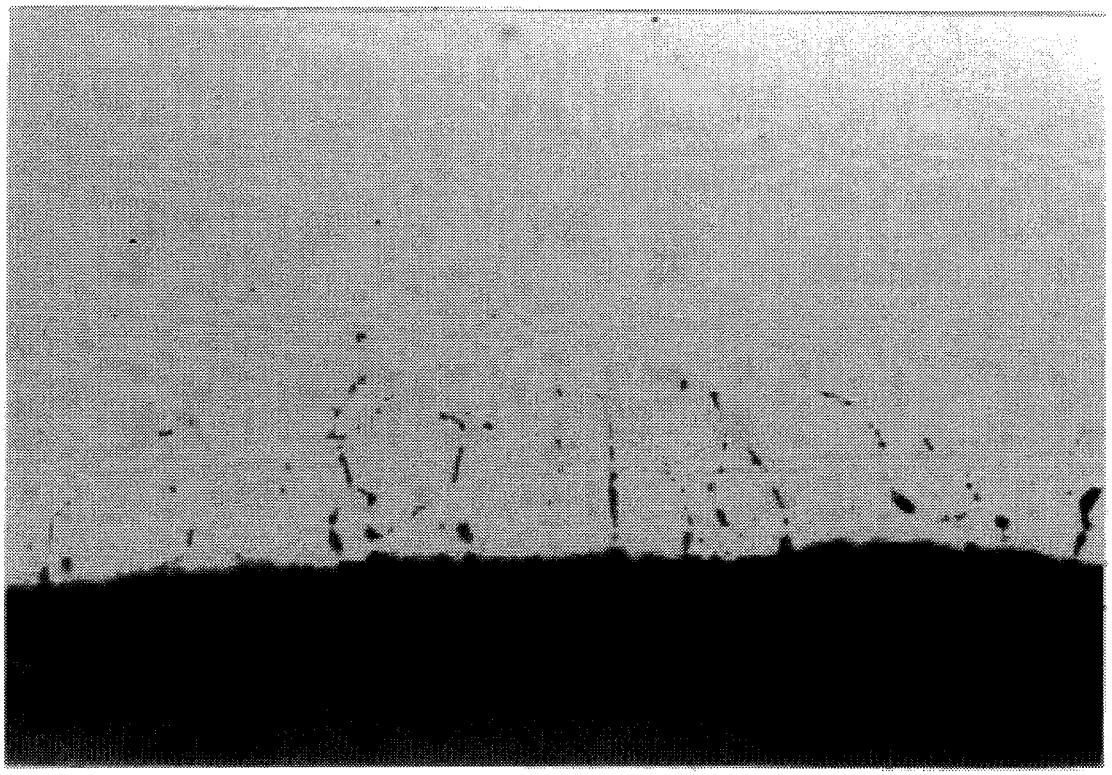
FIG. 5 is a photomicrograph, at 1000X, showing an etched section of a carburized steel gear, carburized with the gear in FIG. 3 but formed of a typical carburizing grade low alloy steel containing 0.22% silicon.

Photomicrographs of the gear sample 5, representing a preferred embodiment of the present invention, is shown in FIG. 3. Advantages of the present invention are emphasized by contrasting it with FIGS. 4 and 5, which are photomicrographs of gear samples 7 and 8. FIGS. 3–5 are all polished and unetched samples in which the intergranular oxides are identified as elongated black areas and the depth of the carburized case is measured and indicated.

It is believed that during carburization, when the carbon atoms diffuse into the austenite phase, the presence of silicon atoms hinders the diffusion process. This is because silicon atoms are larger than iron atoms and are therefore, a substitutional alloying element. A silicon atom in an iron lattice creates a higher stress field that slows the diffusion movement of carbon atoms into interstitial sites.

INDUSTRIAL APPLICABILITY

A low silicon rapid-carburizing steel article formed according to the present invention is particularly useful in making gears, couplings, shafts, bearings, and similar articles subjected to a combination of high bending loads, surface wear and contact fatigue.

It has been found that a restriction, or even a total elimination of silicon in steel, does not necessarily increase the price of steel. Further, any possible increase in the cost of the steel composition, caused by the necessity of silicon-free constituents, is significantly offset by a cost reduction due to reduced carburizing time. Thus, the described process not only forms articles having improved metallurgical surface characteristics without requiring further finishing of the as-carburized surface, but it is also much faster than prior art methods for attaining the desired carburized case depth.

It is known that intergranular oxides reduce the bending fatigue strength of articles. As a result of using a very low silicon steel for forming articles carburized by the process described in the present invention, it has been shown that not only is the case depth significantly enhanced but the intergranular oxides are virtually eliminated from the as-carburized surface.

Other aspects, objects and advantages of this invention can be obtained from a study of the drawings, the disclosure and the appended claims.

I claim:

1. A process for forming a low silicon rapid-carburizing wear resistant steel article, comprising the steps of:

selecting an article formed of a steel material having less than about 0.05% silicon by weight;

carburizing said article first in a boost stage at a carburizing temperature in the range of about 1675° F. (913° C.) to about 1825° F. (996° C.), a carburizing time in the range of about 2 hours to about 25 hours, and a carbon potential in the range of about 1.10% to about 1.35%, and thereafter in a diffuse stage at a carburizing temperature in the range of about 1675° F. (913° C.) to about 1825° F. (996° C.), a carburizing time in the range of about 0.12 hours to about 3.5 hours, and a carbon potential in the range of about 0.75% to about 1.05%, and producing an article having a carburized case depth being at least 5% greater than the carburized case depth of a similar article formed from a steel material having in a range of about 0.09% to about 0.25% silicon by weight and being carburized first in a boost stage and thereafter in a diffuse stage at about the same carburizing temperature, carburizing time, and carbon potential respectively, and forming an as-carburized surface comprising austenite; and quenching said carburized article and transforming said as-carburized surface into a microstructure of martensite and retained austenite.

2. A process for forming a low silicon rapid-carburizing steel article, as set forth in claim 1, wherein the steel material selected has less than about 0.03% silicon by weight.

3. A process for forming a low silicon rapid-carburizing steel article, as set forth in claim 1, wherein in the step of carburizing said article, said carburized case depth is in the range of about 6% to about 13% greater than the carburized case depth of a similar article formed from a steel material having a range of about 0.09% to about 0.25% silicon by weight and being carburized first in a boost stage and thereafter in a diffuse stage at about the same carburizing temperature, carburizing time, and carbon potential respectively.

4. A process for forming a low silicon rapid-carburizing steel article, as set forth in claim 1, wherein the step of carburizing said article in the boost stage includes the step of heating the article in an atmosphere in which the carbon content of the atmosphere is greater than the saturation limit of carbon in austenite at said temperature, said carburizing temperature being in the range of about 1675° F. (913° C.) to about 1825° F. (996° C.).

5. A process for forming a low silicon rapid-carburizing steel article, as set forth in claim 4, wherein during said boost stage, said carbon content is maintained in the range of about 1.15% to about 1.35%, said furnace temperature is maintained at about 1700° F. (927° C.), and said article is held in said furnace for a period of time in the range of about 2 hours to about 25 hours.

6. A process for forming a low silicon rapid-carburizing steel article, as set forth in claim 1, wherein the step of carburizing said article in the diffuse stage includes the step of heating the article in an atmosphere in which the carbon content of the atmosphere is about equal to the saturation limit of carbon in austenite at said temperature, said carburizing temperature being in the range of about 1675° F. (913° C.) to about 1825° F. (996° C.).

7. A process for forming a low silicon rapid-carburizing steel article, as set forth in claim 6, wherein during said diffuse stage, said carbon content is maintained in the range of about 0.75% to about 1.05%, said furnace temperature is maintained at about 1700° F. (927° C.), and said article is held in said furnace for a period of time in the range of about 0.12 hours to about 3.5 hours.

8. A process for forming a low silicon rapid-carburizing steel article, as set forth in claim 1, wherein the step of quenching said carburized article includes quenching in oil.

9. A process for forming a low silicon rapid-carburizing steel article, as set forth in claim 1, wherein the step of quenching is preceded by the step of cooling said carburized article to the hardening temperature of said steel material for a length of time sufficient to attain a uniform temperature throughout the article.

10. A process for forming a low silicon rapid-carburizing steel article, as set forth in claim 9, wherein the step of cooling is immediately followed by the step of maintaining said carburized article at the hardening temperature of the steel material for a time sufficient for equalizing of the core temperature at said hardening temperature.

11. A process for forming a low silicon rapid-carburizing steel article, as set forth in claim 10, wherein the step of maintaining said carburized article at the hardening temperature of the steel material includes maintaining the article at a temperature of about 1550° F. (845° C.) for a period in the range of about 5 minutes to about 60 minutes.

12. A process for forming a low silicon rapid-carburizing wear resistant steel article, comprising the steps of:

selecting an article formed of a steel material having a composition, comprising, by weight percent, a range of about 0.07% to about 0.33% carbon, a range of about 0% to about 0.05% silicon, less than 8% hardenability elements, less than 1% grain refining elements, and the balance iron and trace impurities;

carburizing said article first in a boost stage at a carburizing temperature in the range of about 1675° F. (913° C.) to about 1825° F. (996° C.), a carburizing time in the range of about 2 hours to about 25 hours and a carbon potential in the range of about 1.10% to about 1.35%, and thereafter in a diffuse stage at a carburizing temperature in the range of about 1675° F. (913° C.) to about 1825° F. (996° C.), a carburizing time in the range of about 0.12 hours to about 3.5 hours, and a carbon potential in the range of about 0.75% to about 1.05%, and producing an article having a carburized case depth being at least 5% greater than the carburized case depth of a similar article formed from a steel material having in a range of about 0.09% to about 0.25% silicon by weight and being carburized first in a boost stage and thereafter in a diffuse stage at about the same carburizing temperature, carburizing time, and carbon potential respectively, and forming an as-carburized surface comprising austenite; and quenching said carburized article and transforming said as-carburized surface into a microstructure of martensite and retained austenite.

* * * * *